US008807356B2

(12) United States Patent
Weigand et al.

(10) Patent No.: US 8,807,356 B2
(45) Date of Patent: Aug. 19, 2014

(54) PRODUCT MERCHANDISING OUTPOST SYSTEM

(75) Inventors: Christopher P. Weigand, Sagamore Hills, OH (US); Anthony J. Santarelli, North Olmsted, OH (US); John J. Digney, Wellington, OH (US)

(73) Assignee: American Greetings Corporation, Cleveland, OH (US)

( * ) Notice: Subject to any disclaimer, the term of this patent is extended or adjusted under 35 U.S.C. 154(b) by 352 days.

(21) Appl. No.: 13/023,813

(22) Filed: Feb. 9, 2011

(65) Prior Publication Data

US 2011/0192812 A1 Aug. 11, 2011

Related U.S. Application Data

(60) Provisional application No. 61/302,589, filed on Feb. 9, 2010.

(51) Int. Cl.

| | |
|---|---|
| ***A47F 5/10*** | (2006.01) |
| *A47F 5/13* | (2006.01) |
| *A47F 5/00* | (2006.01) |
| *A47F 5/08* | (2006.01) |

(52) U.S. Cl.

CPC . *A47F 5/10* (2013.01); *A47F 5/137* (2013.01); *A47F 2005/0075* (2013.01); *A47F 5/0815* (2013.01)

USPC ..... 211/183; 211/189

(58) Field of Classification Search

USPC ..... 211/85.8, 59.1, 189, 195, 183, 180; 108/108; 160/351; 40/605

See application file for complete search history.

(56) References Cited

U.S. PATENT DOCUMENTS

| | | | | | |
|---|---|---|---|---|---|
| 2,963,173 | A | * | 12/1960 | Barnes | 211/189 |
| 2,991,889 | A | * | 7/1961 | Levy et al. | 211/190 |
| 3,148,638 | A | * | 9/1964 | Shelor | 108/108 |
| 3,159,437 | A | * | 12/1964 | Jentzen | 312/108 |
| 3,297,374 | A | * | 1/1967 | Radek | 312/108 |
| 3,329,282 | A | * | 7/1967 | Swan et al. | 211/190 |
| 3,463,218 | A | * | 8/1969 | Byrens et al. | 160/135 |
| 3,466,777 | A | * | 9/1969 | Wistrand et al. | 40/605 |
| 3,492,772 | A | * | 2/1970 | Bergman | 52/633 |
| 3,565,152 | A | * | 2/1971 | Cohn et al. | 160/135 |
| 3,830,374 | A | * | 8/1974 | Kassimir | 211/1 |
| 3,931,894 | A | * | 1/1976 | Murphy | 211/189 |
| 3,971,477 | A | * | 7/1976 | Bruderly et al. | 211/189 |
| 4,018,340 | A | * | 4/1977 | Gold | 211/44 |
| 4,034,463 | A | * | 7/1977 | Ryan | 29/446 |
| 4,046,083 | A | * | 9/1977 | Murdoch et al. | 108/107 |

(Continued)

*Primary Examiner* — Jonathan Liu
*Assistant Examiner* — Stanton L Krycinski
(74) *Attorney, Agent, or Firm* — Christine Flanagan

(57) ABSTRACT

A product merchandising outpost system of the present invention is a versatile and adaptable system of construction that allows for the merchandising of virtually any product at retail. The finished product can be custom manufactured to specific size, finish, material and design. The display can be assembled in multiple configurations based on the merchandising requirements. The product can also be used with or without several optional components. The display consists of a square tube frame with pre-punched holes approximately every four inches along the top and bottom horizontal frame members. Multiple frames can be attached together to create several merchandising display configurations using manufactured connectors. Each frame is outfitted with a merchandising panel. A decorative or functional element, such as display headers and decorative fins may also be attached to the outside of the frame. The entire product merchandising outpost system can be built or reconfigured in the field with common tools and without welding.

2 Claims, 15 Drawing Sheets

(56) References Cited

U.S. PATENT DOCUMENTS

| | | | | | |
|---|---|---|---|---|---|
| 4,093,078 | A | * | 6/1978 | Radek | 211/189 |
| 4,118,903 | A | * | 10/1978 | Coulthard | 160/351 |
| 4,312,086 | A | * | 1/1982 | Bianco | 5/2.1 |
| 4,434,900 | A | * | 3/1984 | Cook | 211/189 |
| 4,444,322 | A | | 4/1984 | Lee | |
| 4,460,097 | A | * | 7/1984 | Darnell et al. | 211/189 |
| 4,508,231 | A | * | 4/1985 | Honickman | 211/199 |
| 4,526,110 | A | * | 7/1985 | Franz | 108/108 |
| 4,566,211 | A | * | 1/1986 | Gustafson et al. | 40/605 |
| 4,597,231 | A | * | 7/1986 | Quest | 52/239 |
| 4,637,153 | A | * | 1/1987 | Kane et al. | 40/605 |
| 4,722,284 | A | * | 2/1988 | Wilson et al. | 108/108 |
| 4,761,922 | A | * | 8/1988 | Black | 52/71 |
| 4,805,783 | A | * | 2/1989 | Mayer | 211/94.01 |
| 4,919,282 | A | * | 4/1990 | Duff et al. | 211/134 |
| 4,947,601 | A | * | 8/1990 | McGuire | 52/239 |
| 4,969,568 | A | * | 11/1990 | Yoshida | 220/4.33 |
| 5,014,862 | A | * | 5/1991 | Bustos | 211/193 |
| D318,384 | S | * | 7/1991 | Terrell et al. | D6/415 |
| 5,078,283 | A | * | 1/1992 | Wilson | 211/187 |
| D324,790 | S | * | 3/1992 | Krautsack | D6/455 |
| 5,167,191 | A | * | 12/1992 | Muth | 108/108 |
| D336,183 | S | * | 6/1993 | Klein, III | D6/467 |
| 5,255,803 | A | * | 10/1993 | Pavone et al. | 211/189 |
| 5,483,779 | A | * | 1/1996 | Crawford et al. | 52/645 |
| 5,566,844 | A | * | 10/1996 | Bernardin | 211/189 |
| 5,607,070 | A | * | 3/1997 | Hellyer | 211/189 |
| 5,785,190 | A | * | 7/1998 | Otema | 211/189 |
| 5,857,578 | A | * | 1/1999 | Fishman | 211/189 |
| 5,890,607 | A | * | 4/1999 | Maglione | 211/189 |
| 5,918,750 | A | * | 7/1999 | Jackson | 211/189 |
| 5,921,190 | A | | 7/1999 | Wood | |
| 5,944,203 | A | * | 8/1999 | Vlah et al. | 211/189 |
| 6,024,230 | A | | 2/2000 | Menaged et al. | |
| 6,029,833 | A | * | 2/2000 | Yeh | 211/189 |
| 6,062,402 | A | * | 5/2000 | Ford | 211/189 |
| 6,105,292 | A | * | 8/2000 | Current | 40/605 |
| 6,116,326 | A | * | 9/2000 | Domina et al. | 160/351 |
| 6,164,467 | A | * | 12/2000 | DePottey et al. | 211/189 |
| 6,193,083 | B1 | * | 2/2001 | Wood | 211/87.01 |
| D457,751 | S | * | 5/2002 | Stafford et al. | D6/456 |
| 6,415,567 | B1 | * | 7/2002 | Mead et al. | 52/239 |
| 6,427,857 | B1 | * | 8/2002 | Adams et al. | 211/189 |
| 6,457,595 | B1 | * | 10/2002 | Pritchard et al. | 211/189 |
| 6,601,349 | B1 | * | 8/2003 | Corden | 52/36.5 |
| 6,681,532 | B1 | * | 1/2004 | Palmbos et al. | 52/71 |
| 6,739,463 | B2 | * | 5/2004 | Wishart et al. | 211/189 |
| D500,417 | S | * | 1/2005 | Levin et al. | D6/457 |
| 6,848,589 | B2 | | 2/2005 | Wood | |
| 6,935,523 | B2 | | 8/2005 | Ahn | |
| 6,951,085 | B2 | * | 10/2005 | Hodges et al. | 52/220.7 |
| 6,955,268 | B2 | | 10/2005 | Waldron | |
| 6,978,906 | B2 | * | 12/2005 | Wishart et al. | 211/189 |
| 7,185,460 | B2 | * | 3/2007 | Corden | 52/36.5 |
| 7,641,063 | B2 | * | 1/2010 | Wishart et al. | 211/189 |
| 7,810,658 | B2 | * | 10/2010 | Clark et al. | 211/189 |
| 7,886,919 | B2 | * | 2/2011 | Battaglia et al. | 211/189 |
| 7,954,656 | B1 | * | 6/2011 | Cuzzocrea | 211/189 |
| 8,028,846 | B2 | * | 10/2011 | Peota et al. | 211/187 |
| 2003/0155319 | A1 | * | 8/2003 | Wishart et al. | 211/189 |
| 2004/0011755 | A1 | | 1/2004 | Wood | |
| 2005/0167383 | A1 | | 8/2005 | Taccolini et al. | |
| 2005/0173362 | A1 | | 8/2005 | Squitieri et al. | |
| 2006/0011565 | A1 | * | 1/2006 | Pirro et al. | 211/59.2 |
| 2006/0016774 | A1 | * | 1/2006 | Bustos | 211/186 |
| 2007/0119808 | A1 | * | 5/2007 | Wishart et al. | 211/189 |
| 2007/0170139 | A1 | * | 7/2007 | Clark et al. | 211/189 |
| 2008/0314849 | A1 | | 12/2008 | Duchatellier | |
| 2009/0255638 | A1 | * | 10/2009 | Hardt, II | 160/351 |

* cited by examiner

PRODUCT MERCHANDISING OUTPOST SYSTEM

RELATED APPLICATIONS

This application claims priority to U.S. Provisional Patent Application No. 61/302,589 filed on Feb. 9, 2010, which is incorporated herein in its entirety.

FIELD OF THE INVENTION

The present invention is in the field of retail displays and more specifically to configurable product merchandising systems.

BACKGROUND OF THE INVENTION

Retail outpost display structures are merchandising displays that are placed in various remote locations within a retail store that contain merchandise that is not typically sold in the area of the display. The design and manufacture of such structures is oftentimes expensive, inflexible and time consuming due to individual retailer needs and the wide assortment of products that may be displayed upon the structure. Typically, new merchandise displays are designed and manufactured with the yearly change of merchandise inventory. Outposts are sometimes designed to a certain set of criteria which may hinder placement and longevity of the outpost and product. Also, different display types often call for different manufacturing and assembly methods. Current retail merchandising display systems lack sufficient flexibility for utilization in different shopping environments. Space requirements and aisle configurations often differ considerably not only from store to store but also from department to department. Retail displays are usually designed with a specific store set and floor plan in mind and are adaptable to a different floor plan only at considerable expense and time. A considerable cost is also associated with the oftentimes complicated assembly and disassembly of intricate display systems. Another potentially costly consideration is that individual retailer's may require that all merchandising displays are customized so as to create differentiation among retailers. These requirements often result in the production of a costly, inflexible display system.

SUMMARY OF THE INVENTION

The product merchandising outpost system of the present disclosure and related inventions is a versatile and adaptable system of construction that allows for the merchandising of virtually any product at retail. The components can be assembled and used as a simple outpost display or may be configured for an entire department. The unique design and construction methods employed allow for a wide range of customization to suit merchandised product and retailer needs through manufacturing, ordering and set up. The design and implementation of this system takes into account material selection, manufacturing, set up, maintenance and disposal. The finished product can be custom manufactured to a specific size, finish, material and design. The product merchandising outpost system is designed to provide a variety of merchandising configurations while maintaining consistent manufacturing and assembly methods. The system can be built or reconfigured in the field with common tools and, the same frame can be connected to other frames in a variety of configurations via multiple spaced holes in the frame and shaped connectors. The system utilizes a separate frame and panel system—the frame for overall display configuration and the panel for merchandising method. The frame contains multiple attachment points for mounting, both the merchandising panel inside as well as optional decorative or functional elements outside the frame.

DETAILED DESCRIPTION OF PREFERRED AND ALTERNATE EMBODIMENTS

Figure 2:
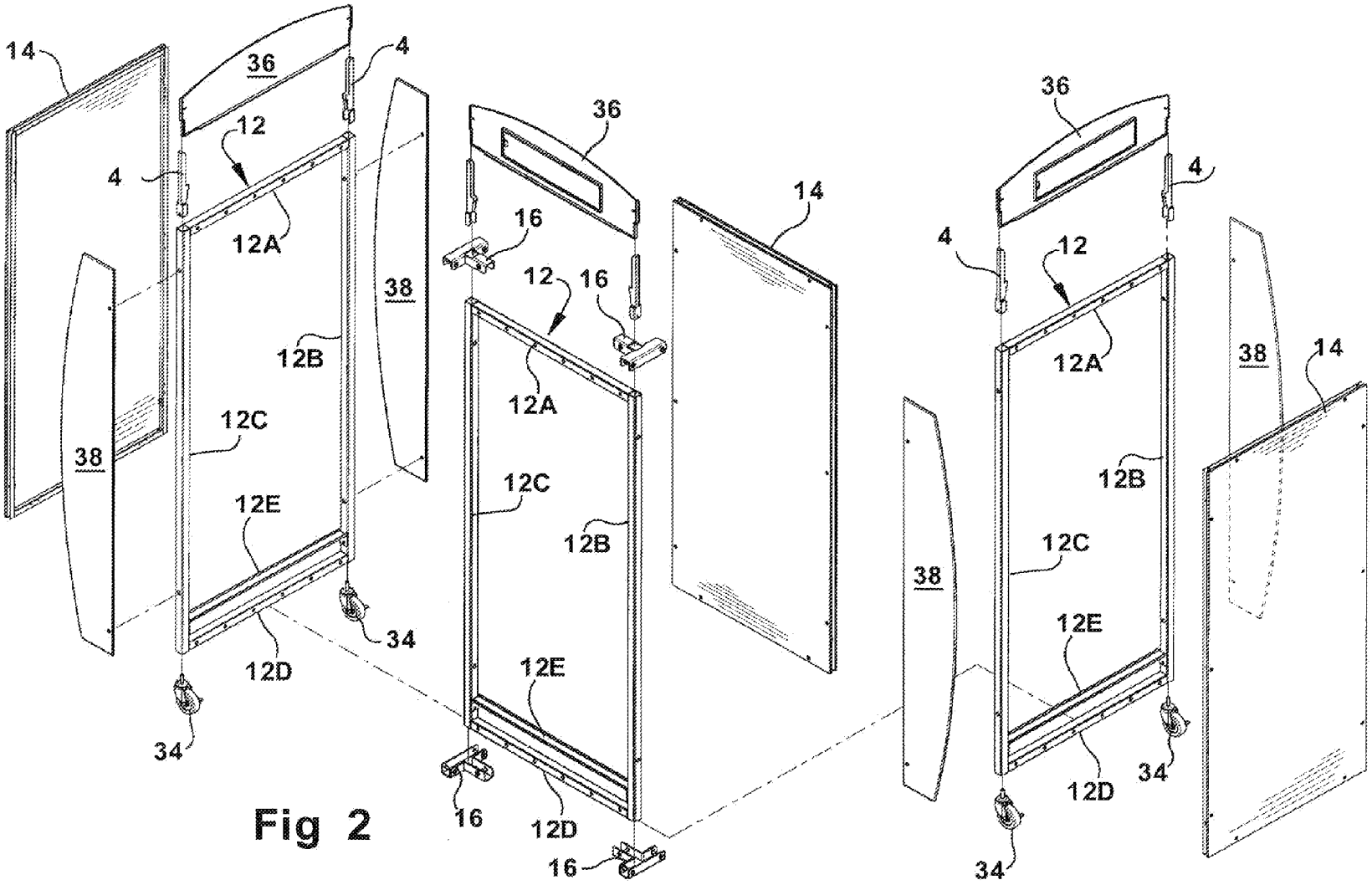
FIG. 2 is an exploded view of the Product Merchandising Outpost of FIG. 1.

The product merchandising outpost system incorporates a limited number of basic components that can be combined to produce a variety of fixtures that can be assembled using common tools. Components of the system are manufactured to a standard size but can easily be customized to suit the needs of a particular retailer. This allows for the production of several standard parts or components that can be kept on hand so that they are readily available when needed, thus avoiding substantial lead and development time. In FIG. 2, an h-shaped configured outpost is shown having display panels 10 which are made up of two separate components—a tube frame assembly 12 and a panel assembly 14, which provide for a panel-within-a-frame configuration. The outer tube frame assembly 12 consists of a 1-inch by 1-inch square metal tube frame having upper and lower horizontal segments 12A, 12D and right and left side vertical segments 12B, 12C arranged in a rectangular fashion. An additional bar or "saddle" 12E runs horizontally across the frame proximate to the lower horizontal tube frame 12D. This saddle 12E serves as a rest area for the inner panel 14 to rest on during removal of the inner panel 14. The frame 12 is shown in standard 16-inch and 24-inch sizes but may be manufactured in other sizes as required. The upper and lower horizontal segments 12A, 12D of the tube frame are manufactured with pre-positioned mounting holes located at approximately 4-inch intervals to accommodate multiple hardware connectors used to connect, frames to one; another and also to attach various add-on components. The right and left vertical tube frame members 12B, 12C are manufactured with two pre-positioned holes, one of the holes located approximately 10.25 inches from the top of the vertical segment and the other hole located approximately 10.25 inches from the bottom of the vertical segment. The inner panels 14, which are shown as single or double sided pegboard, are inserted into the rectangular tube frame 12 and attached through the two pre-positioned mounting holes. While pegboard panels are shown, the inner panel 14 may be made of laminate, metal, translucent pegboard, wood, wire, slat wall or other functional or decorative material. The inner panels 14 are manufactured in standard 16-, 24- and 32-inch sizes in order to minimize the amount of scrap used when cutting panels from a standard 4-foot by 8-foot sheet. Other sizes may be used as necessary. The panel-within-a-frame configuration of an outer tube frame 12 in combination with an inner panel 14 creates a flexible display panel assembly 10 wherein the inner panel 14 may be easily removed and replaced with a different panel. For example, if a retailer needs to change the look or functionality of a display panel, the panel itself may be removed and replaced with a more suitable panel while still utilizing the outer frame. Since the inner panel 14 and outer frame 12 are not welded together, as is customary in the field, the two components may be easily separated and re-used with other components.

Figure 3A:
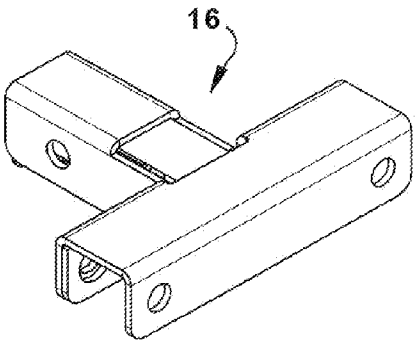
FIG. 3A is a perspective view of a t-connector bracket in a downward facing position.
Figure 3B:
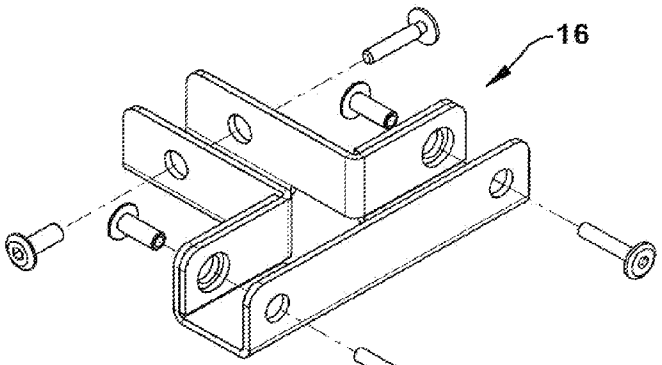
FIG. 3B is a perspective view of a t-connector bracket in an upward facing position.
Figure 5B:
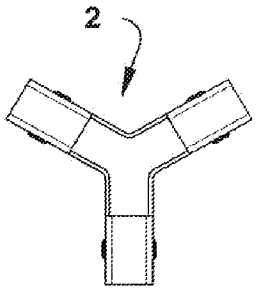
FIG. 5B is a top view of a y-connector bracket.
Figure 5A:
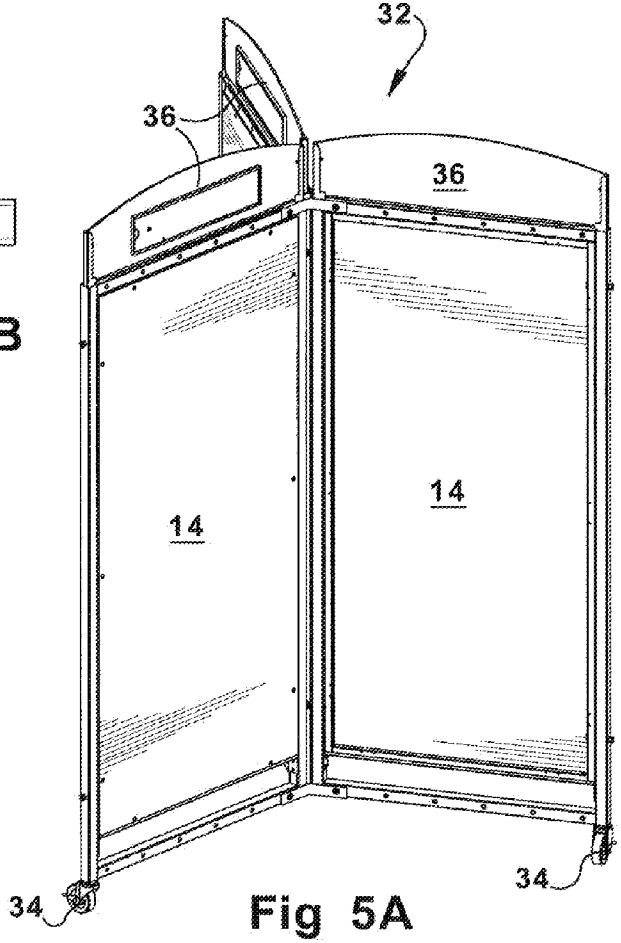
FIG. 5A is a perspective view of a Product Merchandising Outpost in a tri-star configuration.
Figure 4B:
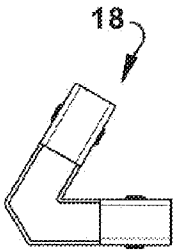
FIG. 4B is a top view of a v-connector bracket.
Figure 4A:
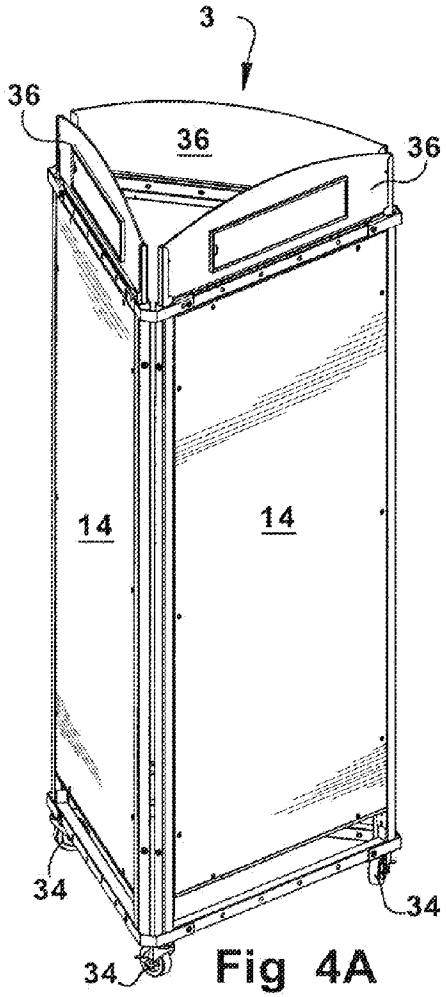
FIG. 4A is a perspective view of a Product Merchandising Outpost in a tri-beacon configuration.
Figure 6A:
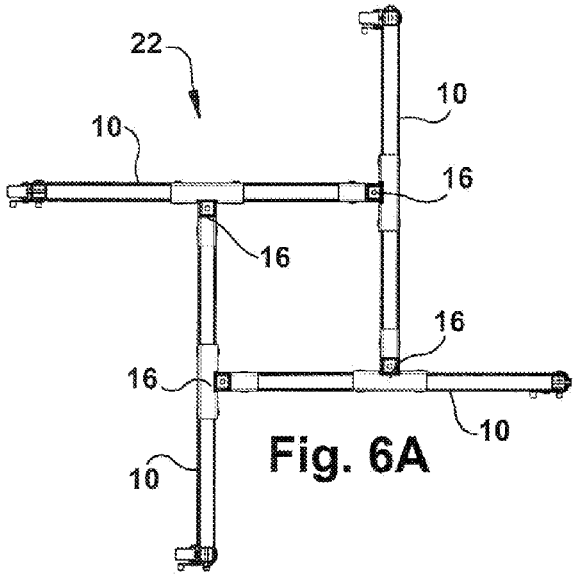
FIG. 6A is a top view of a Product Merchandising Outpost in a pinwheel configuration.
Figure 6B:
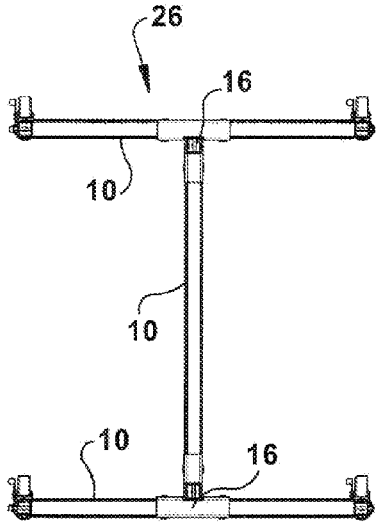
FIG. 6B is a top view of a Product Merchandising Outpost in an h-shaped configuration.
Figure 6C:
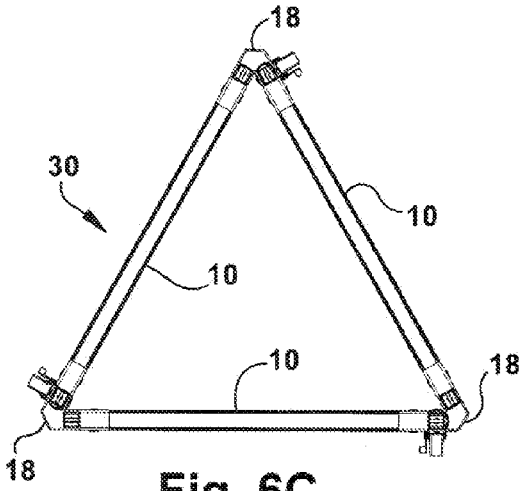
FIG. 6C is a top View of a Product Merchandising Outpost in a tri-beacon configuration.
Figure 6D:
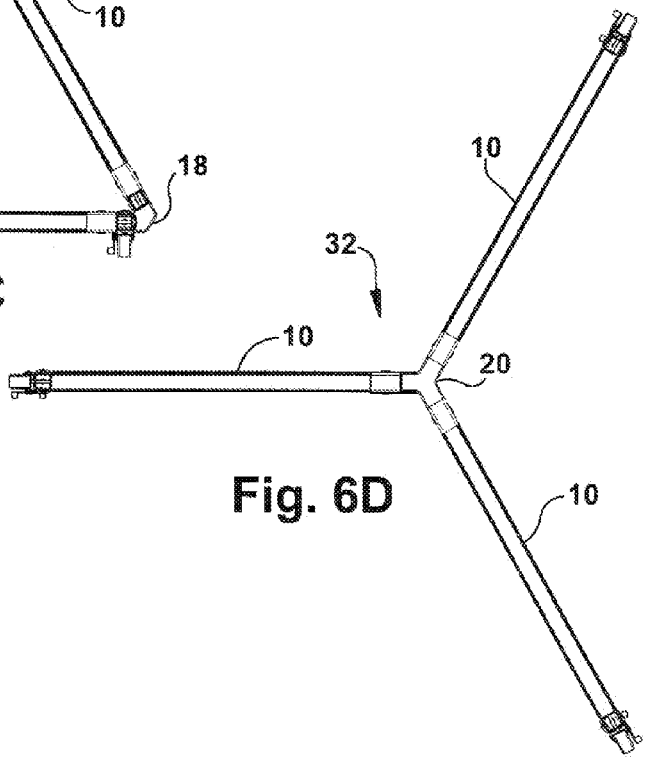
FIG. 6D is a top view of a Product Merchandising Outpost in a tri-star configuration.
Figure 7B:
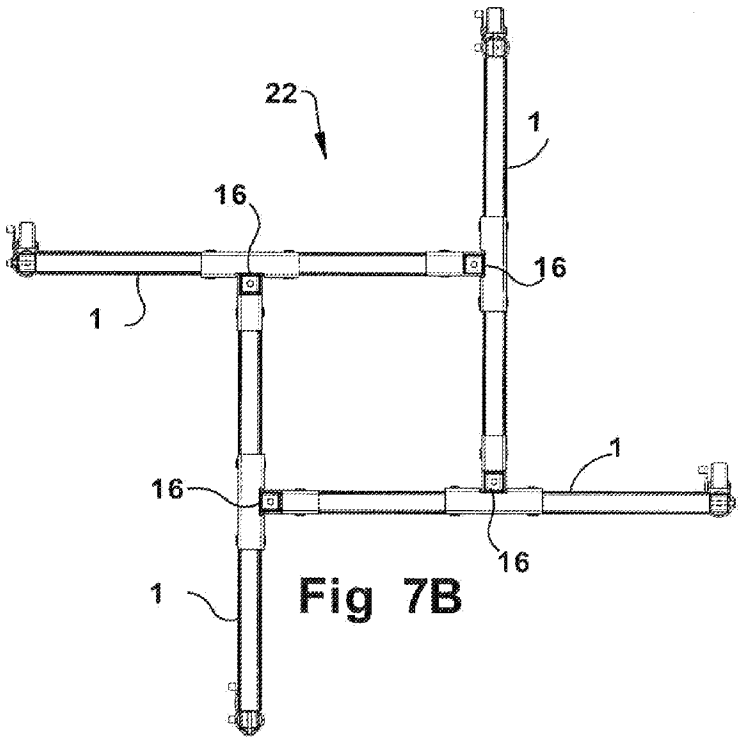
FIG. 7B is a top view of the Product Merchandising Outpost of FIG. 7A.
Figure 7A:
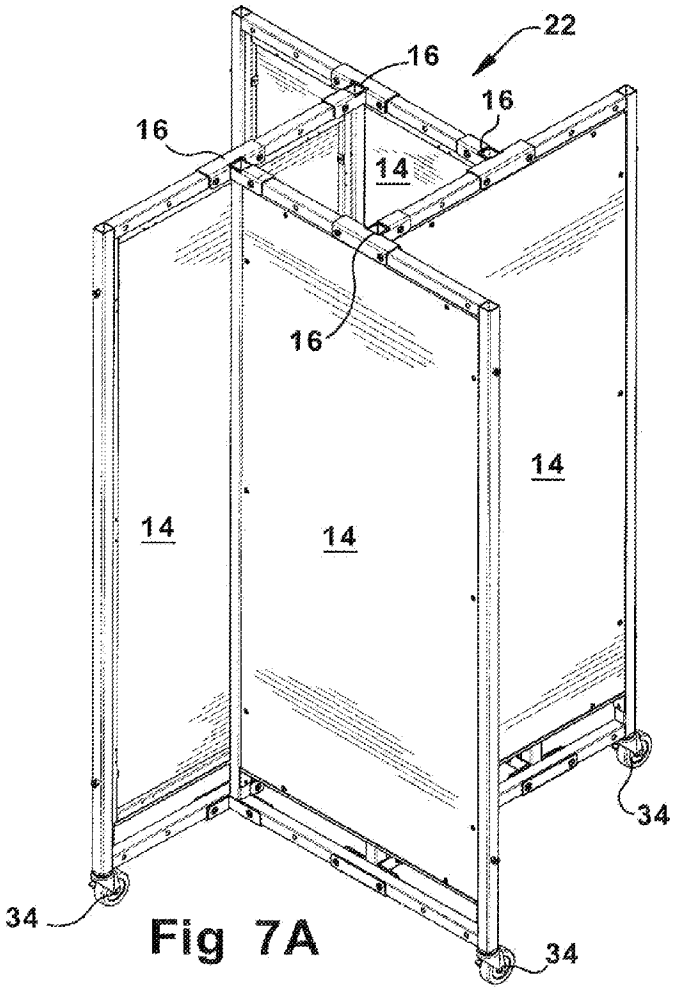
FIG. 7A is a perspective view of a Product Merchandising Outpost in a pinwheel configuration.
Figure 8B:
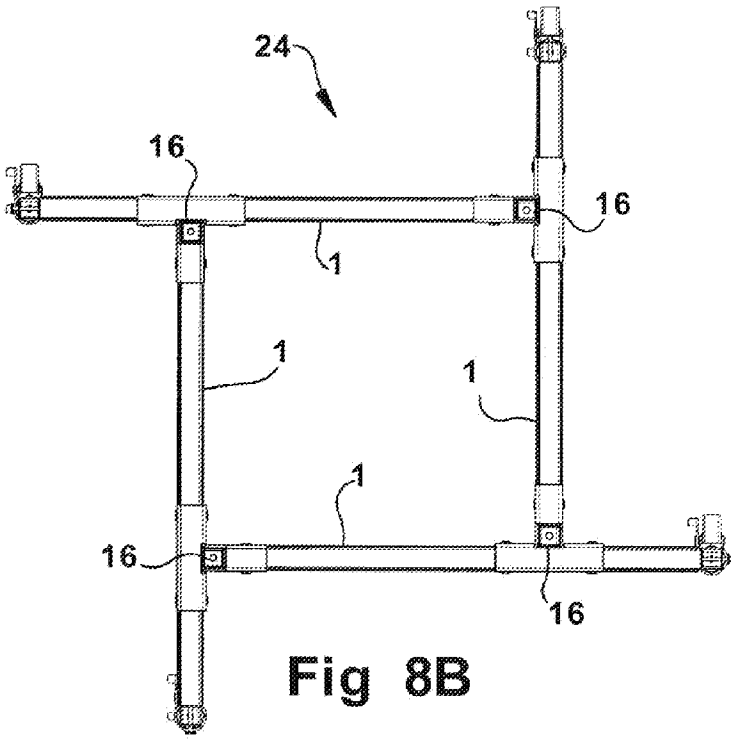
FIG. 8B is a top view of the Product Merchandising Outpost of FIG. 8A.
Figure 8A:
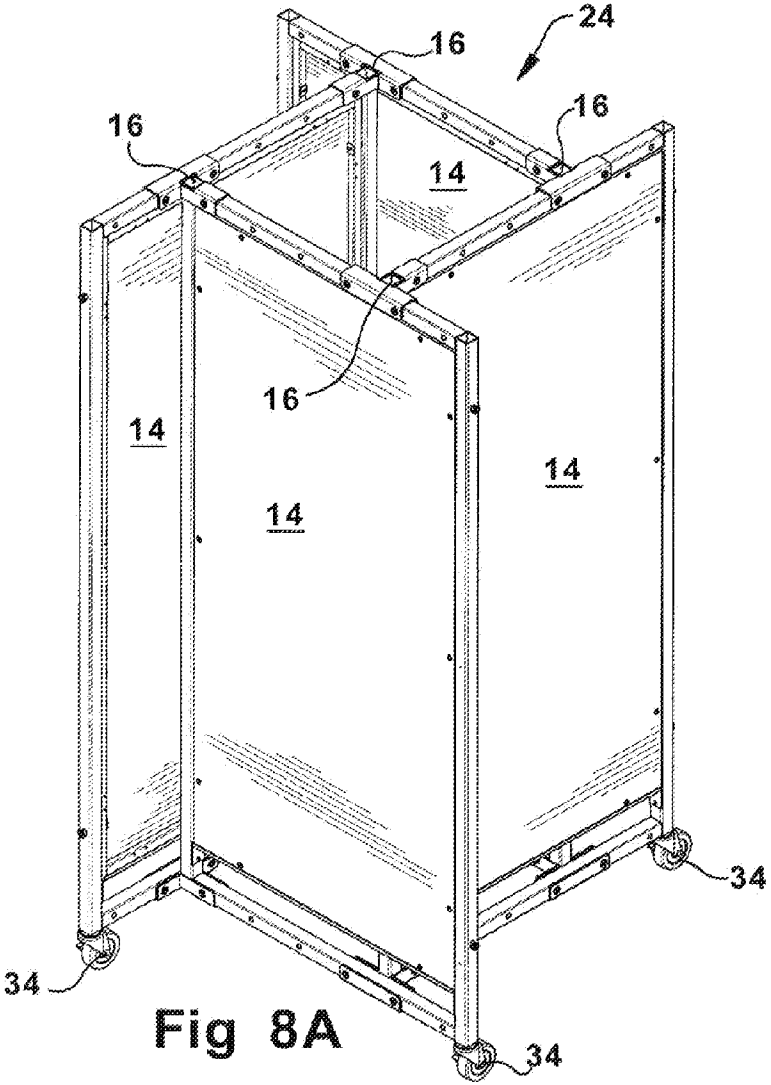
FIG. 8A is a perspective view of a Product Merchandising Outpost in an alternate pinwheel configuration.
Figure 9B:
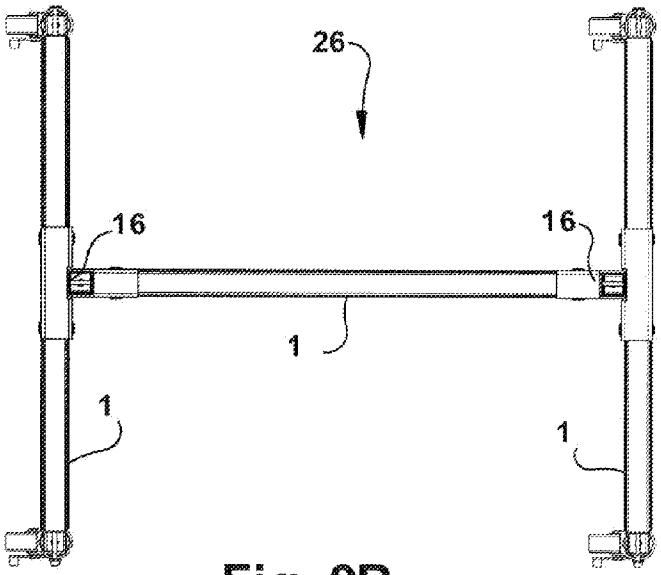
FIG. 9B is a top view of the Product Merchandising Outpost of FIG. 9A.
Figure 9A:
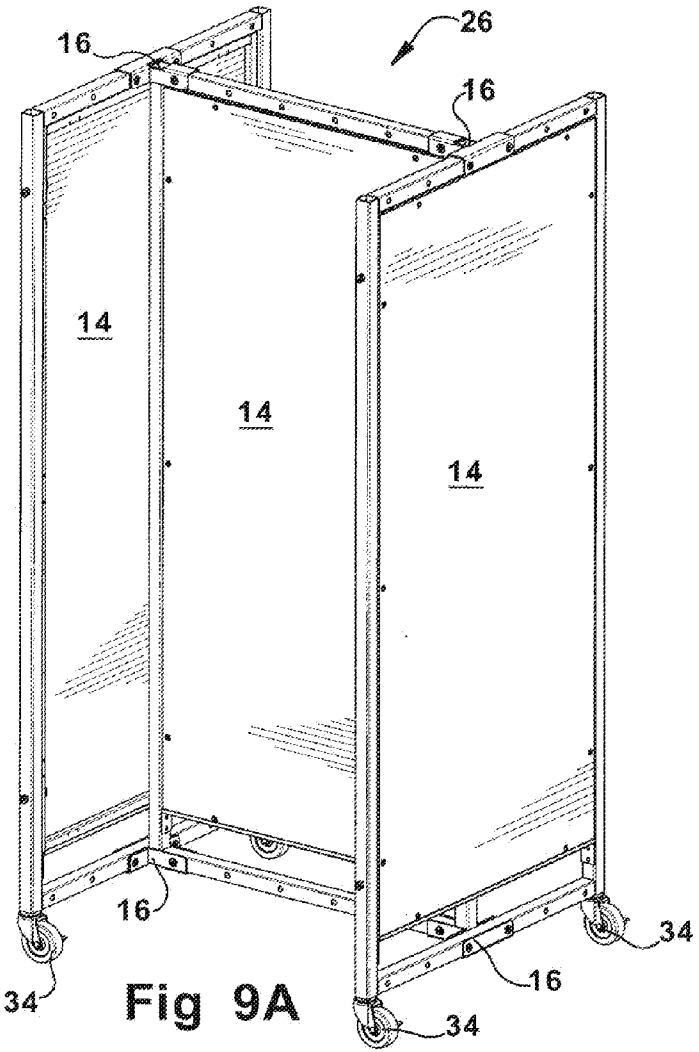
FIG. 9A is a perspective view of a Product Merchandising Outpost in an h-shaped configuration.
Figure 10B:
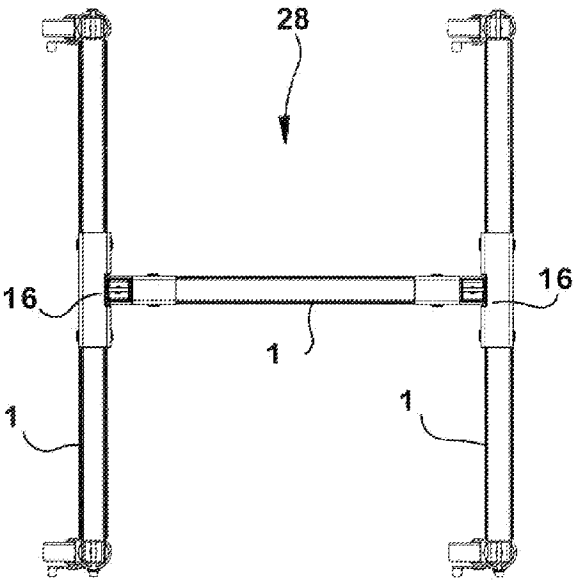
FIG. 10B is a top view of the Product Merchandising Outpost of FIG. 10A.
Figure 10A:
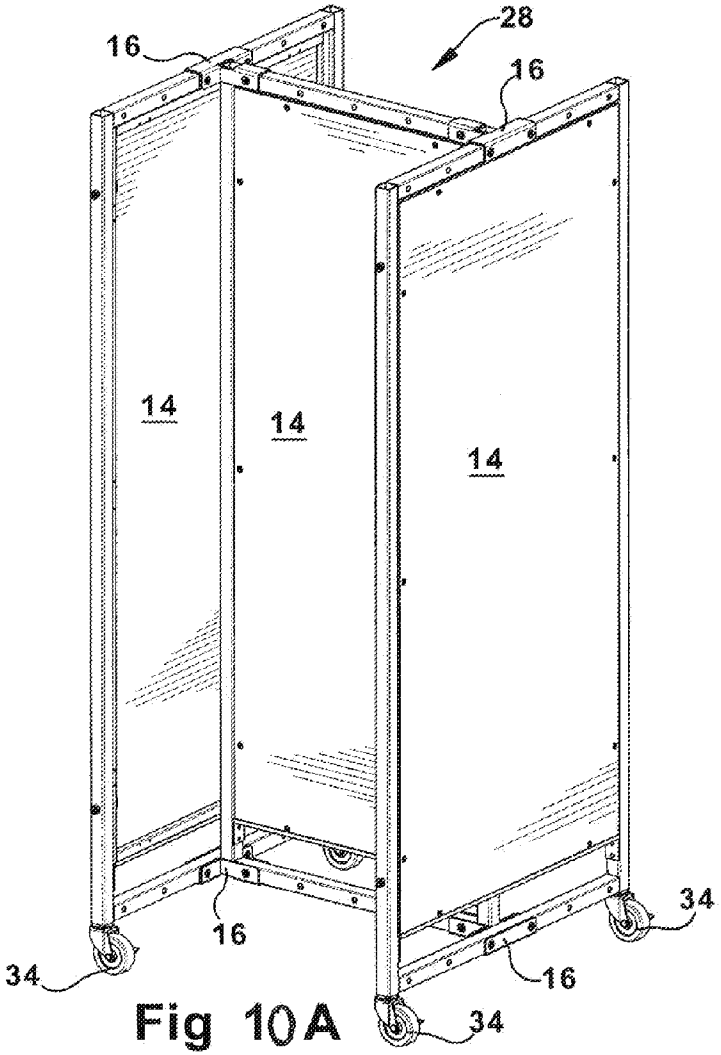
FIG. 10A is a perspective view of a Product Merchandising. Outpost in an alternate h-shaped configuration.

A display panel assembly 10 is easily capable of being connected with one or more additional display panel assemblies 10 to create a variety of display configurations such as, for example, an h-frame 26, pinwheel 22, tri-beacon 30, or tri-star display 32. A standard set of connectors, which includes, but is not limited to, T-connectors 16, v-connectors 18, and y-connector 20 brackets, is used to construct such configurations. A t-connector bracket 16 is shown in FIGS. 3A and 3B. It contains one vertical segment that bisects a horizontal segment in the shape of the letter T. The t-connector bracket 16 contains an inner recess dimensioned to fit over portions of the one-inch tube frame. It also contains several pre-positioned mounting holes used to connect frames to the connector. A standard v-connector bracket 18 is shown in FIG. 4B and a standard y-connector 20 in FIG. 5B. A representative sample of the flexible panel configurations is shown in FIGS. 6A-6D. FIG. 6A shows how t-connector brackets 16 can be used to construct a pinwheel display 22 having four L-shaped display arrangements on which merchandise can be displayed. A standard pinwheel display 22 is shown in FIGS. 7A, 7B. The t-connector brackets 16 are located at the top center of each frame 12. A mixture of pegboard and slatwall inner panels 14 can be used or any other combination of panels as required. A slight variation of the pinwheel display is shown in FIGS. 8A, 8B. In this configuration, the t-connector brackets 16 are placed in a slightly offset manner creating a pinwheel display 24 having shorter side extension panels on each of the four display sides. FIGS. 9A, 9B show the use of t-connector brackets 16 to configure a standard h-frame display 26 which provides one two-sided panel having two additional panels attached to each end. It contains a maximum of four complete display surfaces. A standard h-frame configuration 26, as shown in FIGS. 9A, 9B contains a 32-inch center panel with two 24-inch side panels. This creates more display space along the two sides of the center panel. A variation of the standard h-frame display 28 is shown in FIGS. 10A, 10B. This configuration 28 uses one 24-inch center panel and two 32-inch side panels, thereby creating a wider display at each end. FIG. 4A shows a tri-beacon display 30 having three display panels 10 arranged in a triangular configuration using a v-connector bracket 18. FIG. 5A shows a tri-star display 32 having three double-sided display panel assemblies 10 connected at one end using a y-connector bracket 20. Each display panel assembly 10 radiates outward from the y-connector 20, providing six surfaces upon which merchandise may be displayed.

Each display configuration can be fitted with a variety of foot or base assemblies depending on the size of the display and the type of configuration. For example, a smaller display assembly may be fitted with castors 34 for easy movement to different merchandise areas or departments. Other base assemblies include locking castors, non-marring glides, adjustable levelers or spinners.

Figure 1:
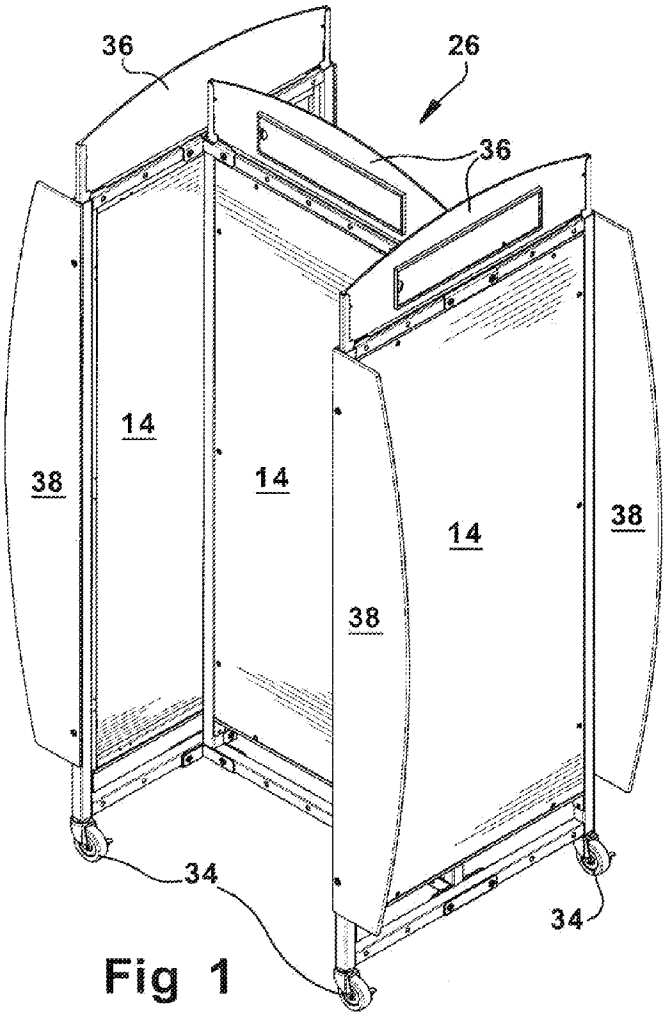
FIG. 1 is a perspective view of a representative Product Merchandising Outpost of the present invention.
Figure 11C:
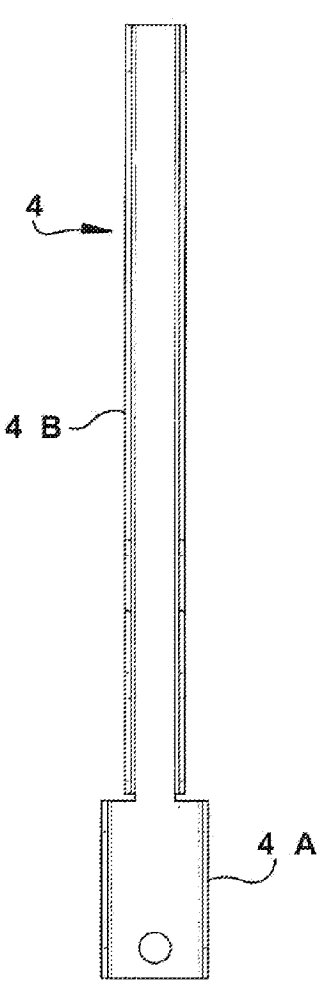
FIG. 11C is a top view of the sign post of FIG. 11A.
Figure 11B:
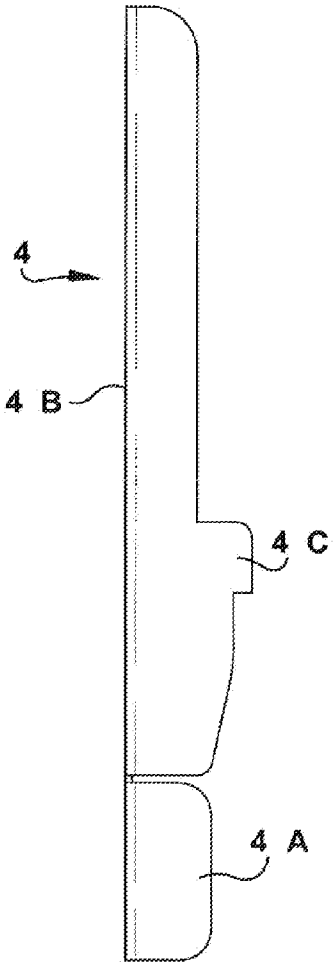
FIG. 11B is a side view of the sign post of FIG. 11A.
Figure 11A:
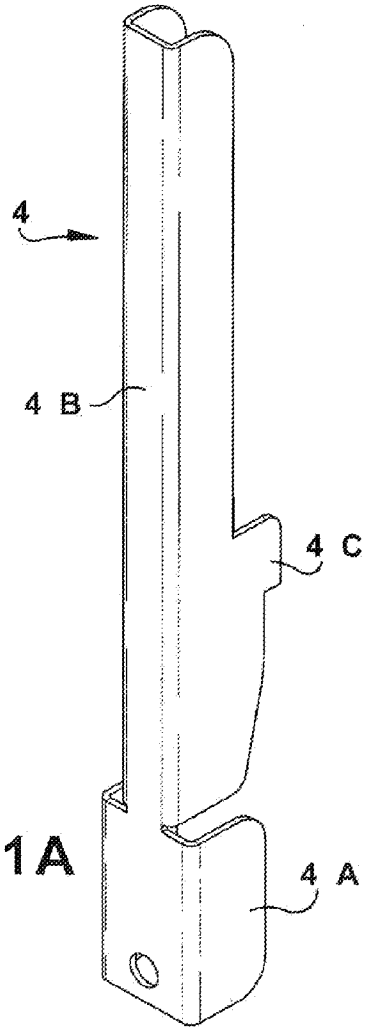
FIG. 11A is a perspective view of a sign post.
Figure 23:
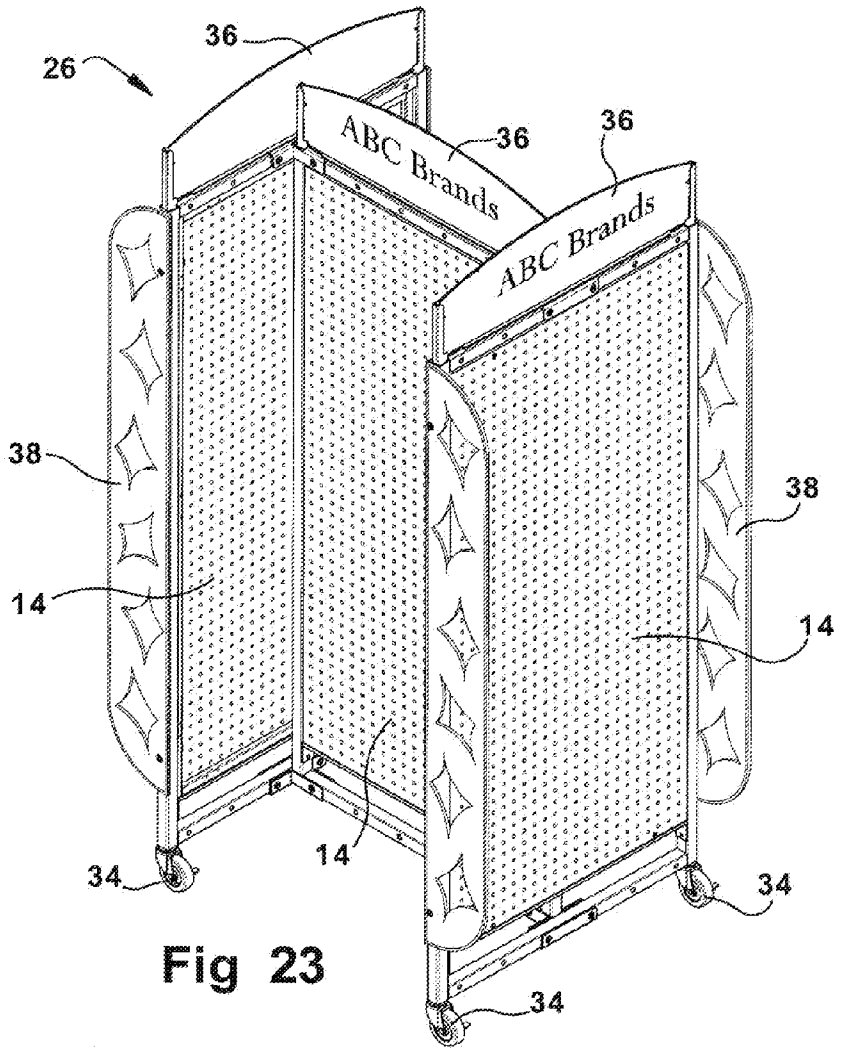
FIG. 23 is a perspective view of a customized Product Merchandising Outpost in an h-shaped configuration.

While the standardization of parts and, modular components provide an overall similarity based on the simplicity of design and the ease of adaptability, each merchandise display configuration is customizable to create a unique product merchandising system. For example, the frame and panels can be manufactured with different color and material options. Frames are typically made of metal but can be made of any other suitable material. Frames may be black, white, silver or any other color desired by the retailer. Inner panels 14 are typically pegboard but may be metal, translucent pegboard, wood, wire, slatwall or other functional or decorative material. Also available to create a distinctive looking display are optional display headers 36 and decorative fins 38. Display headers 36 are typically used to display merchandise signage which directs a consumer to a particular type of merchandise. Display headers 36 may also be used for purely decorative purposes. Sign posts 40 are used to secure a display header 36 to the top of a display frame 12. The top corner of each tubular frame 12 contains a square hole or opening. Sign posts 40 are inserted into these holes or openings. A representative sign post 40, as shown in FIGS. 11A-11C, is an elongated connector having a lower portion 40A that contains a U-shaped recess having one hole punched on each parallel side of the recessed member for insertion into and attachment to the open top corners or each tube frame 12. An upper portion 40B of the sign post 40 also contains a U-shaped recess that is narrower than the lower recessed portion. A notch 40C which extends outward from both sides of the upper portion 40B serves to limit the portion of the sign post 40 that can be inserted into the tube frame 12. Once a sign post 40 is inserted into opposite corners of a tube frame 12, as shown in FIG. 2, a display header 36 can be inserted into the upper recessed portion of the sign post 40 that protrudes from each end of the tube frame 12. A representative display header 36, as shown in FIG. 2, is a substantially rectangular planar sign having a slightly arched top section. One display header 36 can be affixed to the top of each frame 12, as shown in FIG. 1. Decorative fins 38 may also optionally used to create a unique look or style to each merchandise display assembly. Each fin 38 is a substantially rectangular planar piece of material that may be attached to the vertical side members of each tube frame 12B, 12C. As discussed above, each vertical frame member 12B, 12C contains two pre-punched holes. Once an inner panel 14 has been attached to the tube frame 12, two exposed screw heads protrude from the right and left vertical sides 12B, 12C of the tube frame 12. Each decorative fin 38 contains notches used to connect the fin to the exposed screw heads on the frame 12, as shown in FIG. 2. Decorative, fin 38 options include, but are not limited to woodgrain fins; frosted fins; sculpted wire fins; laser cut fins; wood fins; or any other suitable material and/or design. An h-frame display assembly 26, including display headers 36 and decorative fins 38, is shown in FIG. 1. In addition to the decorative aspect of the fins 38, they also have a functional aspect, which is to protect the merchandise contained between a pair of fins 38 attached to a display panel 10. A fully assembled h-frame configured product merchandising outpost 26 with custom display headers 36 and decorative fins 38 is shown in FIG. 23.

Figure 15:
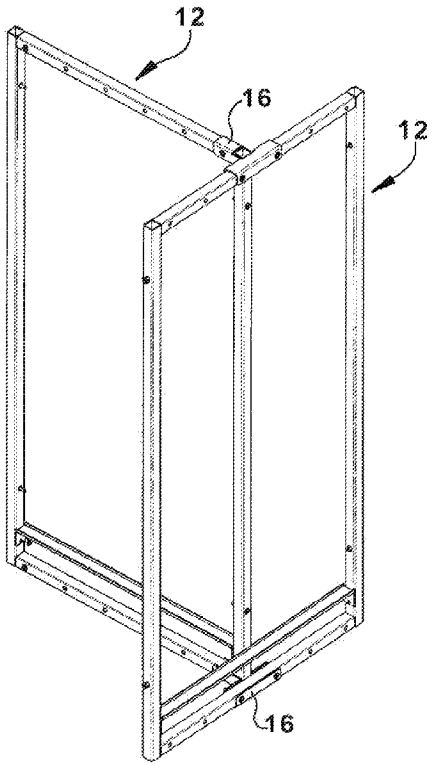
FIGS. 12-22 depict a representative Product Merchandising Outpost in an h-shaped configuration in various stages of assembly.
Figure 14:
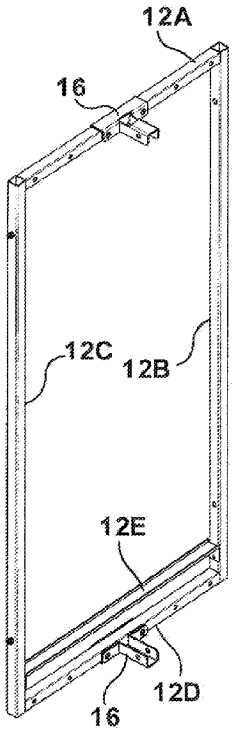
Figure 13:
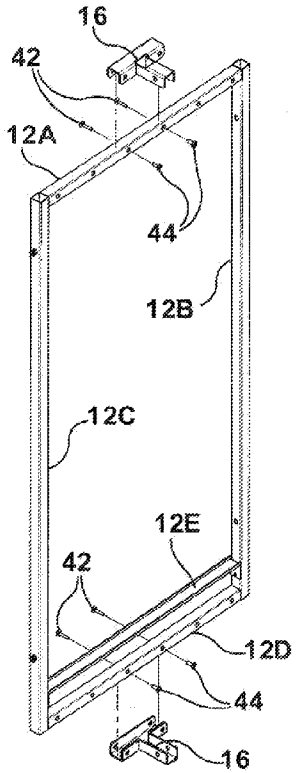
Figure 12:
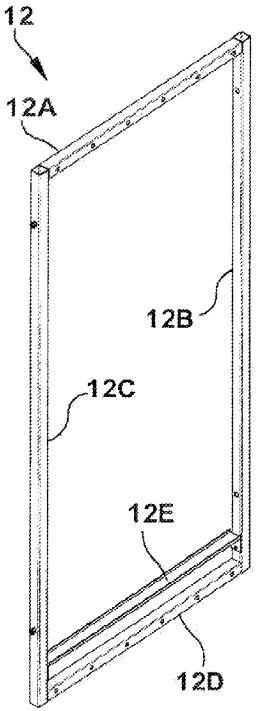
Figure 17:
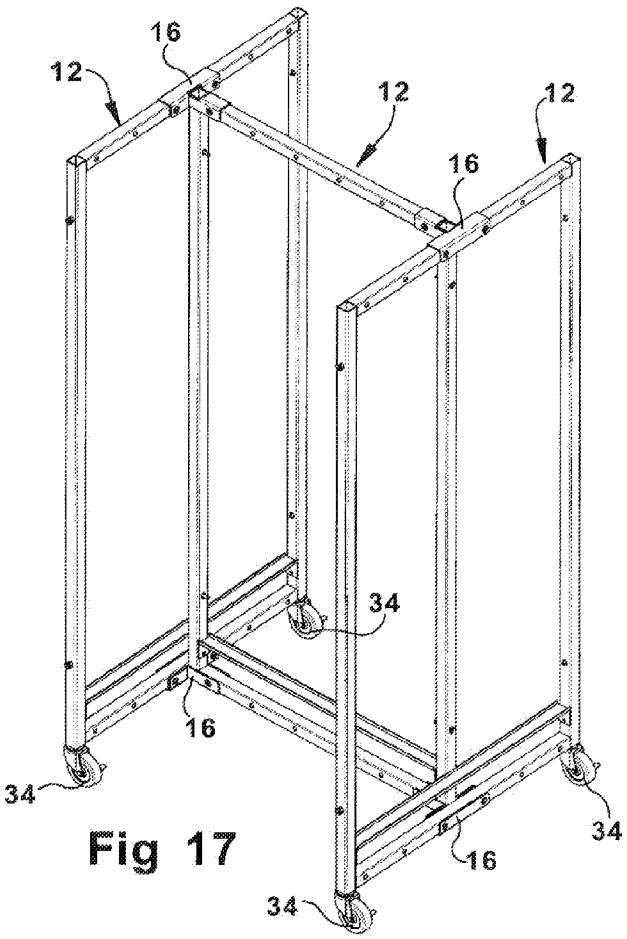
Figure 16:
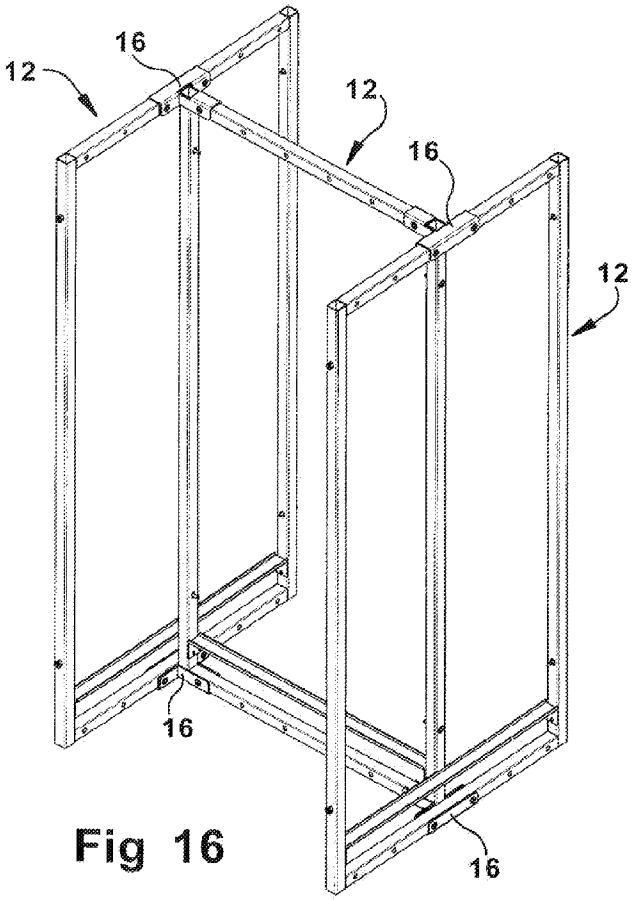
Figure 19:
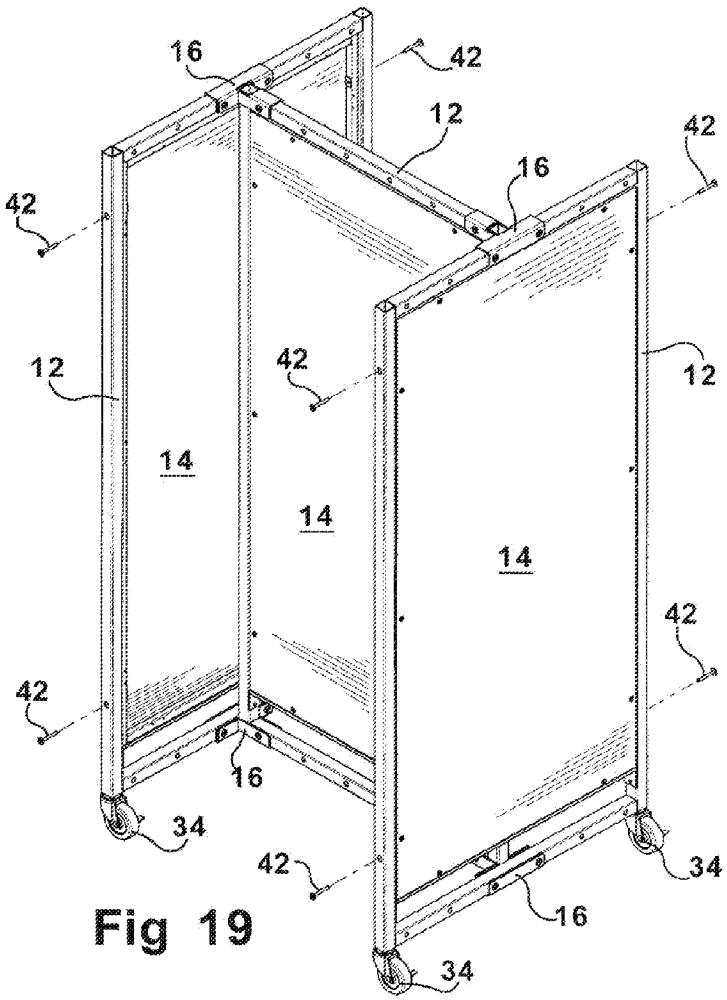
Figure 18:
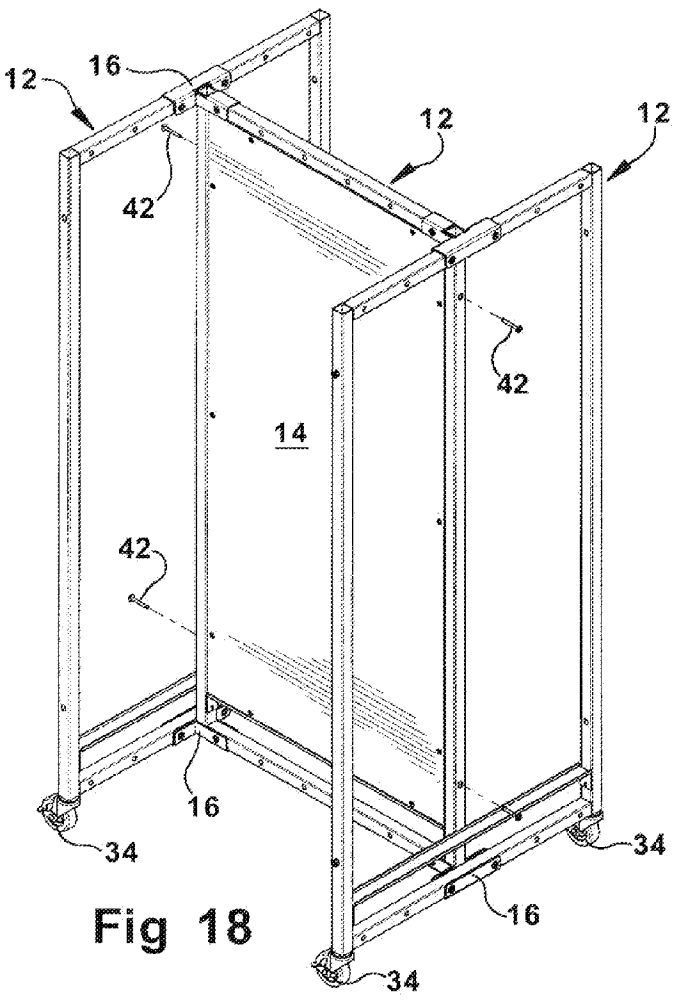
Figure 20:
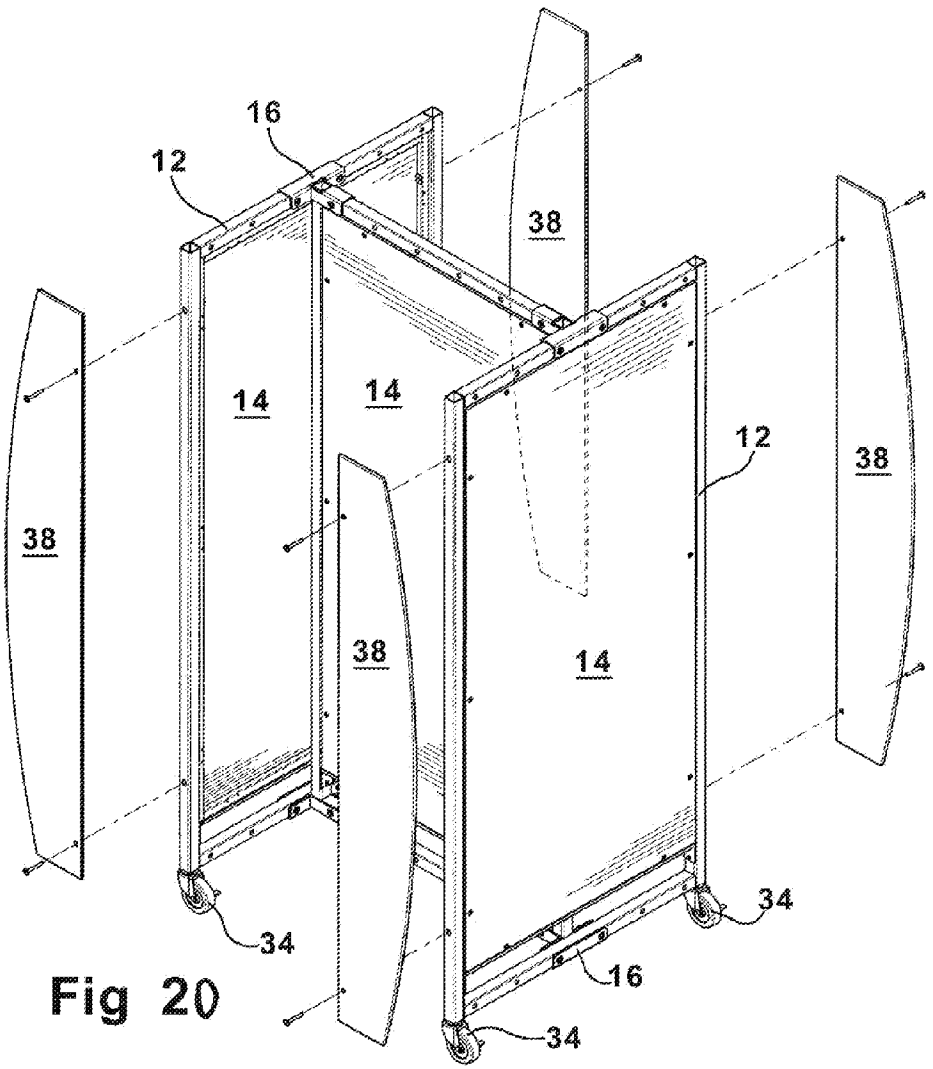
Figure 22:
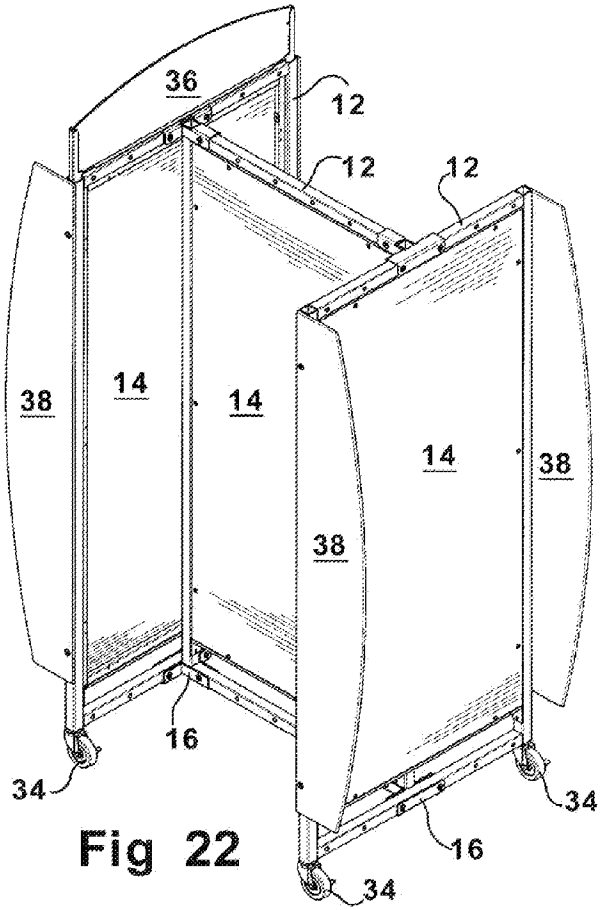
Figure 21:
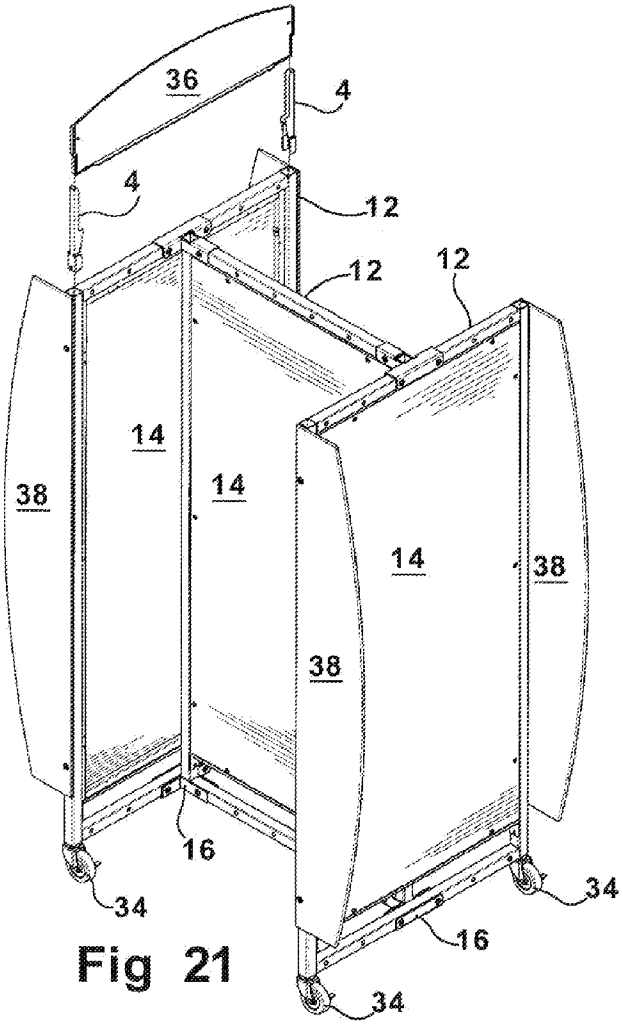

Assembly of a representative product merchandising outpost system, as shown in FIGS. 12-22, is easy and requires only standard hardware assembly tools. As previously discussed, a standard set of parts are used to assemble, for example, a standard h-frame display configuration. These components include three 24-inch frames 12; two single-sided pegboard panels 14; one double-sided pegboard panel 14; four castors 34; four t-connector brackets 16 with hardware; three 2-inch headers 36; six header posts 40 and four optional decorative fins 38. Attachment hardware may include standard screws, nuts, cap nuts, bolts, joint connector bolts or any other standard attachment mechanisms. Assembly begins with a first frame assembly 12 (FIG. 12). A first t-connector bracket 16 is placed over the desired hole set on the top horizontal frame member 12A of the first frame member 12 so that the t-connector bracket 16 is horizontally centered and attached to the top horizontal frame member 12A using two screws 42 and two joint connector nuts 44. Likewise, a second t-connector bracket 16 is horizontally centered and attached to the bottom horizontal frame member 12D, as shown in FIGS. 13 and 14. A second; frame assembly 12 is inserted at one end, into the t-connector brackets 16 attached to the first frame assembly 12 using two screws 42 and two joint connectors 44 for each t-connector bracket 16. The first and second frame assemblies 12 are positioned in a perpendicular or t-shaped configuration, as shown in FIG. 15. Next, a third frame assembly 12 is attached, via two t-connector brackets 16, to the opposite end of the second frame assembly 12 so that the three frame assemblies 12 are connected in an h-shaped configuration 26, shown in FIG. 16. Four castors 34 are inserted into holes located at each end of the first and second frames 12, shown in FIG. 17. Now that the frame is assembled, the panels 14 may be inserted into each frame 12. A double-sided pegboard panel 14 is attached to the second frame assembly 12 which is located at the center of the h-shaped configuration, as shown in FIG. 18. With the panel 14 resting on the saddle 12E, the double-sided pegboard panel 14 is fastened into place. Next, two single-sided pegboard panels 14 are attached to the first and third frame assemblies 12, shown in FIG. 19. Display headers 36 and/or decorative fins 38 may optionally be attached to the frames 12 as desired, as shown in FIGS. 20 and 21. A fully assembled representative h-frame product merchandising outpost system 26 of the present invention is shown in FIGS. 1 and 22.

It will be appreciated by persons skilled in the art that numerous variations and/or modifications may be made to the invention as shown in the specific embodiments without departing from the spirit or scope of the invention, as broadly described. The present embodiments are, therefore, to be considered in all respects as illustrative and not restrictive. Other features and aspects of this invention will be appreciated by those skilled in the art upon reading and comprehending this disclosure. Such features, aspects and expected variations and modifications of the reported results and examples are clearly within the scope of the invention where the invention is limited solely by the scope of the following claims.

What is claimed is:

1. A product merchandising outpost system consisting of:

three rectangular frames, each frame having two four-sided horizontal members and two four-sided vertical members welded together at the frame corners and a plurality of pre-configured attachment apertures contained thereon;

three display panels, each display panel configured to be removably attached within a respective one of the three rectangular frames;

a plurality of removable hardware brackets selected from the list of: t-connector, y-connector and v-connector;

a base assembly selected from the list of: a castor, a locking castor, a non-marring glide, and adjustable leveler, a spinner stabilizer bracket, a spinner base and a combination thereof;

a plurality of mechanical attachment hardware selected from the list of: screws, nuts, bolts and a combination thereof;

wherein the three rectangular frames, three display panels and the plurality of hardware brackets can be combined to form a tri-beacon, tri-star, or an h-shaped configuration.

2. The product merchandising outpost system of claim 1, wherein the three rectangular frames are 1-inch by 1-inch tube frames.

* * * * *